United States Patent [19]
Kasuya et al.
[11] Patent Number: 4,475,878
[45] Date of Patent: Oct. 9, 1984

[54] SCREW ROTOR WITH TOOTH FORM PRODUCED BY THERMAL DEFORMATION AND GEAR BACKLASH

[75] Inventors: Katsuhiko Kasuya; Hidetomo Mori; Mitsuru Fujiwara; Tetsuzo Matsunaga, all of Ibaraki, Japan

[73] Assignee: Hitachi, Ltd., Tokyo, Japan

[21] Appl. No.: 424,367

[22] Filed: Sep. 27, 1982

[51] Int. Cl.³ ..... F01C 1/16; F01C 1/24
[52] U.S. Cl. ..... 418/201
[58] Field of Search ..... 418/150, 201

[56] References Cited

U.S. PATENT DOCUMENTS 2,325,617 8/1943 Lysholm ..... 418/201
2,683,994 7/1954 Whitfield ..... 418/201
2,901,164 8/1965 Whitfield ..... 418/201
3,179,330 4/1965 MacColl ..... 418/201

*Primary Examiner*—Leonard E. Smith
*Assistant Examiner*—Jane E. Obee
*Attorney, Agent, or Firm*—Antonelli, Terry & Wands

[57] ABSTRACT

A screw compressor including a female rotor and a male rotor rotating while meshing with each other, with the rotor tooth form of one of the female and male rotors meshing with each other without any clearance therebetween in normal temperature condition being used as a basic tooth form for obtaining a rotor tooth form produced by deformation on account of thermal expansion during operation. The basic tooth form and the tooth form thus obtained are employed in the assembled compressor. The rotors with these teeth form, when brought together in meshing engagement, have a clearance at start-up which allows for their expansion. This clearance is maintained at a minimum during operation of the compressor.

12 Claims, 10 Drawing Figures

SCREW ROTOR WITH TOOTH FORM PRODUCED BY THERMAL DEFORMATION AND GEAR BACKLASH

BACKGROUND OF THE INVENTION

This invention relates to screw rotors of screw compressors, and, more particularly, to screw rotors suitable for use with a dry type screw compressor in which the rotors are made to rotate while meshing with each other by synchronizing means, without the rotors coming into contact with each other.

Generally, in dry type screw compressors suitable for use in applications where mingling of oil in the gas discharged from a screw compressor is not desirable, transmission of rotation between a pair of screw rotors is effected through synchronizing means mounted at shaft portions outside the working chambers of the rotors, and at this time the rotors rotate while meshing with each other without coming into contact with each other. The screw rotors of this type of screw compressors have their teeth heated to a higher temperature during operation than the screw rotors of an oil-cooled type screw compressor in which oil is injected into the working chambers for the rotors to mesh with each other in so as to lubricate, cool and seal the two rotors, so that the teeth are subjected to thermal deformation during operation and their shape greatly differs during operation from their shape in inoperative condition in which the temperature is normal. Thus, when the two rotors are designed, it is necessary to select a dimensional relation for them in such a manner that the rotors are prevented from coming into contact with each other and with the casing while a minimum clearance is kept therebetween during operation.

In rotor design of the prior art, however, it has been the usual practice to roughly decide upon the clearance between the two rotors and between the rotors and the casing, so that the clearances provided between the rotors and between the rotors and the casing have no theoretical basis. This has caused problems to arise with regard to the efficiency of the screw compressors.

More specifically, in one practical process known in the art for providing a clearance between the two rotors of a screw rotor, a basic tooth form, for example, given to the male rotor, and a predetermined clearance is provided in the direction of the normal to the tooth form of the female rotor by taking into consideration deformation of the rotors that would occur due to thermal expansion during operation.

This process for deciding the clearance between the rotors is not considered the best because the clearance given to the rotors by this process does not have an optimum value selected by studying in detail the thermal expansion of the rotors and the clearance between the rotors as measured during operation, since the tooth form will undergo deformation in different manners due to thermal expansion and the deformation may vary depending on the tooth form of the rotors.

In, for example, U.S. Pat. No. 3,414,189, for providing a clearance between the rotors, wherein a smaller clearance is given to the rotors in a region in which relative sliding movement between the teeth of the rotors meshing with each other is small and a larger clearance is given to the teeth of the rotor in other regions.

However, this process would not be considered to quantitatively take into consideration the thermal deformation to which the two rotors of the screw compressor would be subjected during operation.

SUMMARY OF THE INVENTION

An object of this invention is to provide a screw rotor capable of maintaining a minimum clearance between a male rotor and a female rotor of a screw compressor during operation through the entire region of the tooth forms of the rotors meshing with each other, to thereby greatly improve the performance of the screw rotor.

Another object is to provide a screw rotor capable of preventing a female rotor and a male rotor of a screw compressor from coming into contact with each other during operation by taking backlash of the synchronizing gears into consideration, to thereby improve the reliability of the screw compressor.

Still another object is to provide a screw rotor capable of greatly improving performance by taking into consideration an axial temperature distribution of the rotor both inside and outside thereof.

To accomplish the aforesaid objects, there is provided, in a screw compressor comprising a female rotor and a male rotor rotating about two axes parallel to each other while in meshing engagement with each other, a screw rotor in which the rotor tooth form of one of the female and male rotors meshing with each other without any clearance therebetween in normal temperature condition is used as a basic tooth form for obtaining a rotor tooth form produced by deformation on account of thermal expansion during operation. The rotor tooth form thus obtained is used for generating another rotor tooth form, and the rotor tooth form thus generated is used to obtain a rotor tooth form which is a normal temperature version of the thermally deformed tooth form, to thereby use the rotor tooth form of the normal temperature version for the other of the female and male rotors.

To accomplish the aforesaid objects, there is further provided, in a screw compressor comprising a female rotor and a male rotor meshing with each other for rotation about two parallel axes through synchronizing means, a screw rotor in which the rotor tooth form of one of the female and male rotors meshing with each other without any clearance therebetween in normal temperature condition is used as a basic tooth form for obtaining rotor tooth form produced by deformation due to thermal expansion during operation of the screw compressor. The first rotor tooth form is adapted to be used for generating a second rotor tooth form, with the rotor second tooth form being adapted to be used to obtain a third rotor tooth form by reducing an amount corresponding to the backlash of the synchronizing means. The third rotor tooth form is adapted to be used to obtain a further rotor tooth form which is a normal temperature tooth form of the second tooth form produced by the deformation of the thermal expansion, whereby one of the basic tooth forms and the further tooth form are the final versions of the tooth forms of the male and female rotors.

To accomplish the aforesaid objects, there is further provided, in a screw compressor comprising a female rotor and a male rotor meshing with each other for rotation about two parallel axes through synchronizing means, the female and male rotors having a basic tooth form for enabling a meshing with each other without any clearance therebetween in normal temperature condition. The basic tooth form of one of the male and female rotors is used form for obtaining a first rotor tooth form produced by deformation due to thermal expansion during operation of the screw compressor. A second tooth form is obtained by adding to the first rotor tooth form amounts of thermal deformation and the backlash of the synchronizing means occurring during operation. The rotor second tooth form is used to generate a third rotor tooth form, and the third rotor tooth form is used to obtain a further rotor tooth form which is a normal temperature tooth form of the second tooth form, whereby one of the basic tooth forms and the further rotor tooth form are the final versions of the tooth forms of the male and female rotors. normal temperature version for the other of the female and male rotors.

DETAILED DESCRIPTION OF THE PREFERRED EMBODIMENTS

Figure 1:
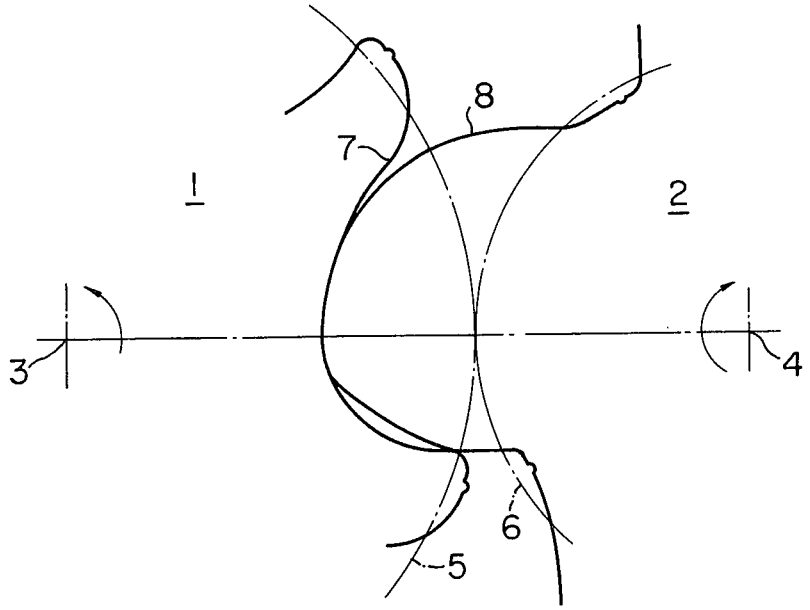
FIG. 1 is a view in explanation of the basic tooth form of the screw rotor according to the invention.
Figure 2:
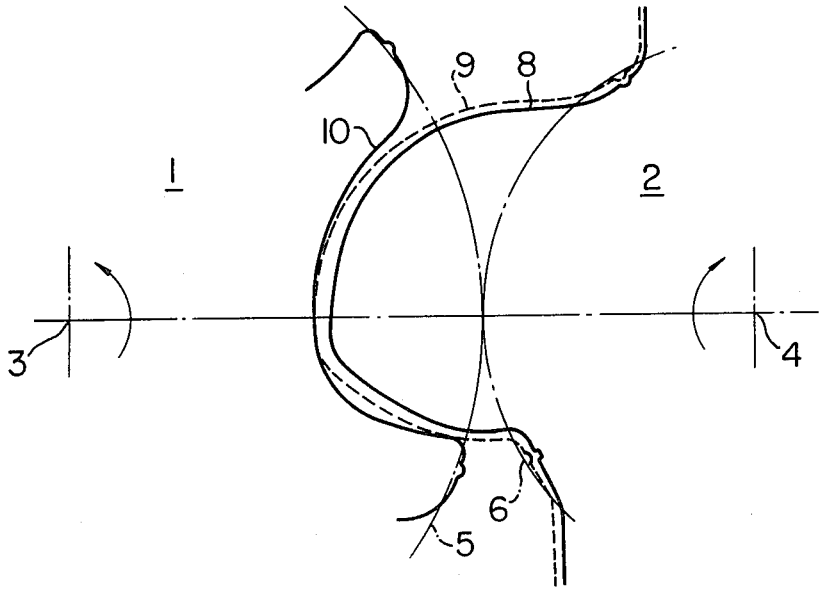
FIGS. 2–5 shows a first embodiment of the screw rotor in conformity with the invention, in explanation of a process for obtaining a screw rotor tooth form.
Figure 3:
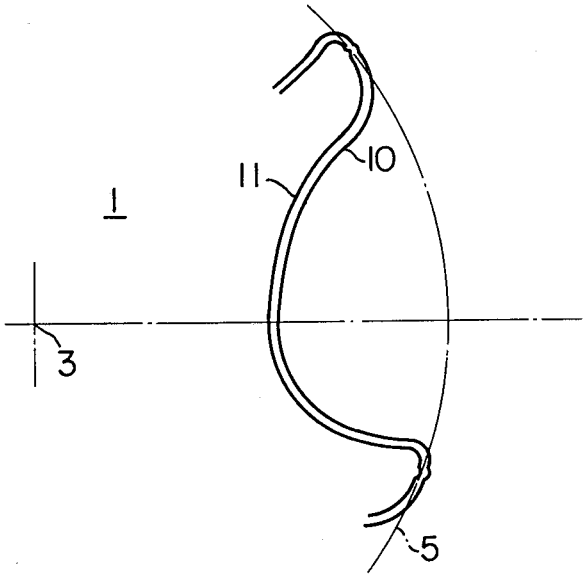

Referring now to the drawings wherein like reference numerals are used throughout the various views to designate like parts and, more particularly, to FIG. 1, according to this figure, a female rotor 1 and a male rotor 2, in meshing engagement with each other, rotate in the direction of arrows about center points 3 and 4, respectively, within a casing, not shown, to enable the compressor to perform its function, with the two rotors 1 and 2 having pitch circles 5, 6. Assume that the female and male rotors 1 and 2 have basic tooth forms 7 and 8 respectively. The basic tooth forms 7 and 8 of the female and male rotors 1 and 2 are brought into meshing engagement with each other without any clearance therebetween in normal temperature condition. The normal temperature condition is the temperature at which the rotors are fabricated (about 20° C.). The invention is not limited to any details of the shape and configuration of the basic tooth forms 7 and 8.

According to the present invention, the basic male rotor tooth form 8 is used as a reference and the female rotor tooth form is obtained by the steps described hereinbelow.

A rotor tooth form 9 is produced by deformation of the basic tooth form 8 due to thermal expansion during operation of the rotors 1 and 2. The rotor tooth form 9 is obtained by calculation by a process of finite elements based on a temperature distribution obtained by measuring the temperatures inside the rotor 2. A rotor tooth form 10 of the female rotor 1 is generated by using the rotor tooth form 9. The rotor tooth form 10 is obtained from the rotor tooth form 9 which is a thermally deformed version of the basic rotor tooth form 8.

A rotor tooth form 11 of the female rotor 1 in normal temperature condition is obtained by converting the rotor tooth form 10 to a rotor tooth form of normal temperature condition. This may be accomplished by calculation by a process of finite elements based on a temperature distribution inside the female rotor, as was used to obtain the rotor tooth form 9.

The rotor tooth form 11 of the female rotor 1 and the basic rotor tooth form 8 of the male rotor 2 are the final rotor tooth forms of the first embodiment which are employed in the assembled compressor of the present invention. The rotors when brought together in meshing engagement having a clearance at start-up which allows for their expansion and this clearance is maintained to a minimum during the operation of the compressor.

Assume that, during operation, the temperature distribution in a cross section perpendicular to the axes of the two rotors 1 and 2 is constant both inside and outside the rotors 1, 2, and that the thermal expansion of the rotors 1, 2 caused by a rise in temperature occurs radially of the rotor in an amount corresponding to the distance between the center of each rotor 1, 2 and an arbitrarily selected point of the rotor tooth form.

Figure 4:
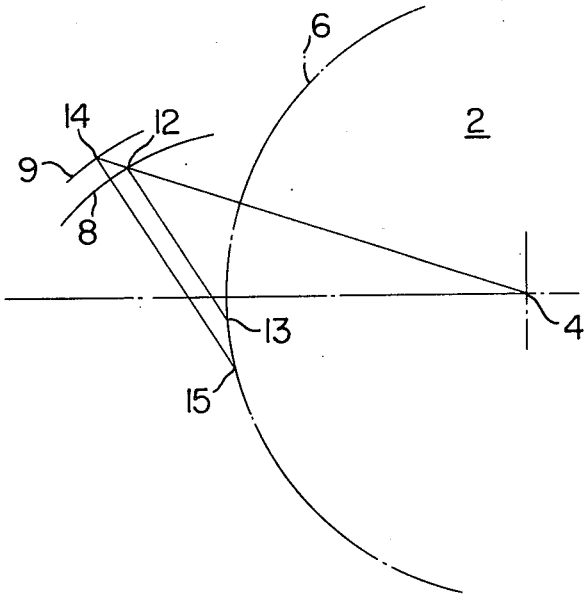

Referring to FIG. 4, the arbitrarily selected point 12 of the basic tooth form 8 of the male rotor 2 has a normal 12–13 perpendicular thereto. Expansion of the rotor tooth form 8 due to a temperature rise causes the point 12 to shift to a point 14. At this time, the normal 14–15 perpendicular to the point 14 moves in parallel to the normal 12–13 and the point 14 exists on the rotor tooth form 9 produced by deformation of the rotor tooth form 8.

The rotor tooth form 9 is obtained by calculating the amounts of thermal expansion taking place in various points of the basic tooth form 8.

Figure 5:
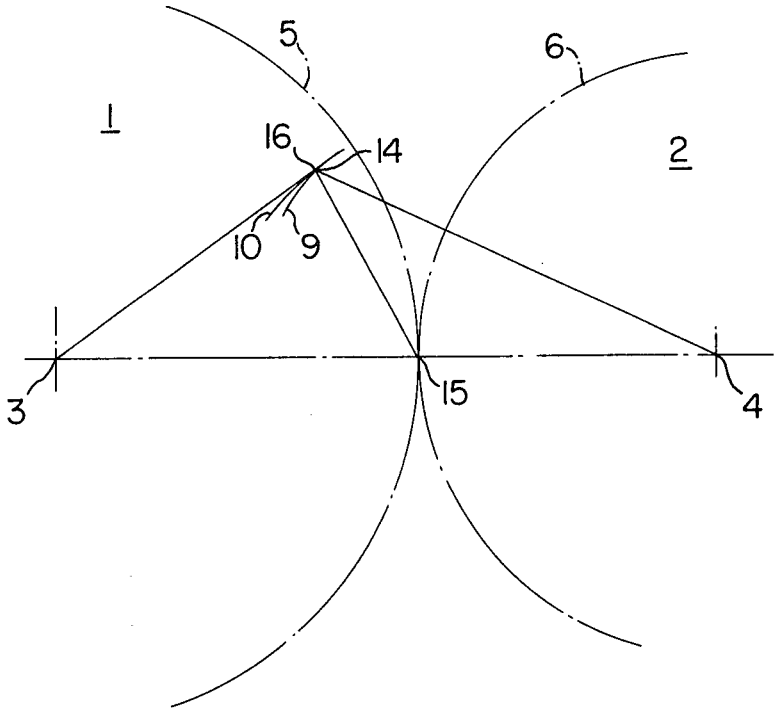

In obtaining the rotor tooth form 10 of the female rotor 1 generated by the rotor tooth form 9 of the male rotor 2 deformed by thermal expansion, a point 16 of the opposite rotor tooth form generated by the point 14 is obtained when the point 15 is located at the pitch point as shown in FIG. 5. The point 16 exists on the rotor tooth form 10.

For converting the rotor tooth form 10 to the rotor tooth form 11, one has only to follow the process for converting the rotor tooth form 8 to the rotor tooth form 9. While the rotor tooth form 9 is a thermally expanded version of the basic tooth form 8, the rotor tooth form 11 is a thermally contracted version of the tooth from 10.

By generating the other rotor tooth form by using one rotor tooth form while taking thermal expansion into consideration, it is possible to maintain the clearance between the female rotor 1 and the male rotor 2 during operation to a minimum through the entire range in which the female and male rotors 1 and 2 mesh with each other. Thus, the screw rotor of the dry type screw compressor can achieve marked improvement in performance as compared with the screw rotor of the oil-cooled type scew compressor.

Figure 6:
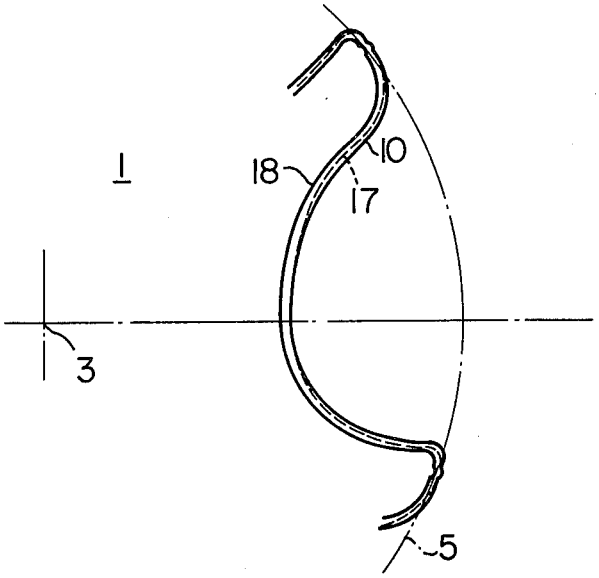
FIGS. 6 and 7 show a second embodiment, in explanation of a process for obtaining a screw rotor tooth form.

As shown in FIG. 6, transmission of rotation between the female rotor 1 and the male rotor 2 is effected through synchronizing means, such as synchronizing gears, not shown, located outside working chambers of the two rotors 1 and 2. In this embodiment, the male rotor 2 is used as a reference and the basic tooth form 8 is given to the male rotor 2. The female rotor tooth form is obtained by taking into account the backlash of the synchronizing gears.

In the second embodiment, the rotor tooth form 10 is obtained in exactly the same way as described in the first embodiment. Thereafter, a rotor tooth form 17 is obtained by reducing from the rotor tooth form 10 of the female rotor 1 an amount corresponding to the backlash of the synchronizing gear and the minimum clearance between the rotors 1 and 2 necessary for avoiding contact between the rotors 1 and 2 while they are in mesh with each other for rotation. A rotor tooth form 18 is obtained by converting the rotor tooth form 17 to a rotor tooth form of normal temperature condition. The rotor tooth form 18 can also be obtained by a process of finite elements based on a temperature distribution inside the female rotor 1. The female rotor tooth form 18 and the basic male rotor tooth form 8 are the final rotor tooth forms of the second embodiment which are employed in the assembled compressor of the present invention. The rotors thus have a clearance at start-up which allows for their expansion, and whereby the clearance is maintained to a minimum during the operation of the compressor.

Figure 7:
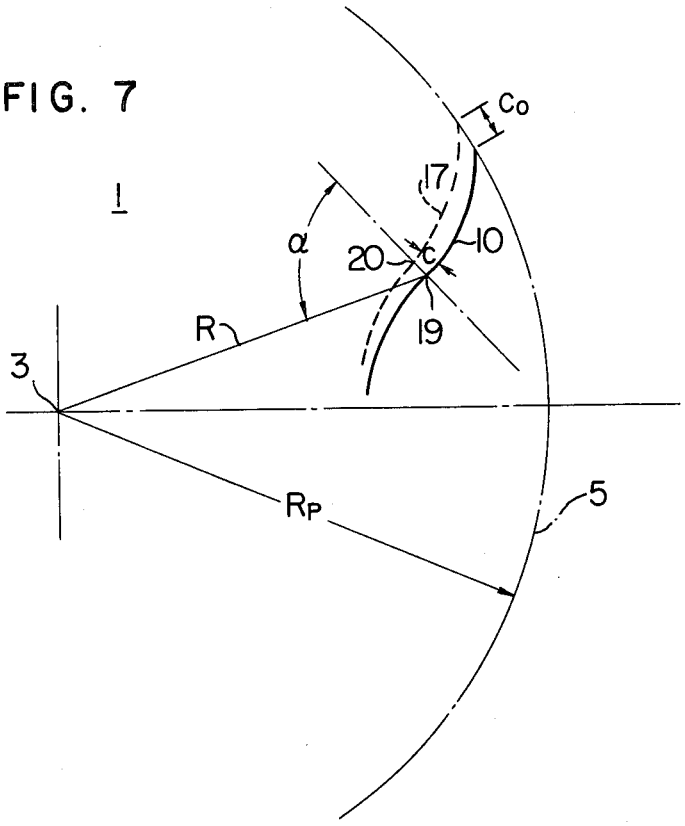

Referring to FIG. 7, to obtain the rotor tooth form 17 let the sum of the backlash of the synchronizing gears on the pitch circle 5 of the female rotor 1 and the necessary minimum clearance between the two rotors 1 and 2, a length 3–19 of the radius vector at an arbitrarily selected point 19 of the rotor tooth form 10 deformed by thermal expansion, an angle formed by the radius vector and the normal perpendicular to the tooth form at the point 19, and a radius from the center 3 to the pitch circle 5 be denoted by $C_o$, R, $\alpha$ and $R_p$, respectively. Then the point 19 arbitrarily selected on the rotor tooth form 10 becomes a point 20 when the backlash is taken into consideration. The distance C between the two points 19 and 20 can be expressed by the following formula:

$$C=R/R_p \cdot C_o \cdot \sin \alpha.$$

The rotor tooth form 17 which takes the backlash into consideration can be obtained from the rotor tooth form 10 deformed by thermal expansion based on this formula.

In converting the rotor tooth form 17 to the rotor tooth form 18, one has only to follow the aforesaid process for converting the rotor tooth form 8 to the rotor tooth form 9. While the rotor tooth form 9 is a thermally expanded version of the basic tooth form 8, rotor tooth form 18 is a thermally contracted version of the rotor tooth form 17.

The reason why the backlash is taken into consideration is as follows. If synchronizing gears are used as synchronizing means, better effects can be achieved in operation by taking into consideration the backlash which is inevitable when the synchronizing gears operate, to obtain optimum meshing.

By taking into consideration the backlash of the synchronizing gears for the female and male rotors 1 and 2 deformed by thermal expansion in operation, it is possible to avoid contacting of the two rotors 1, 2 during operation, thereby improving the reliability of the screw compressor. The performance of the screw compressor can, of course, be improved by minimizing the backlash that is taken into consideration in the allowable range of values.

Figure 8:
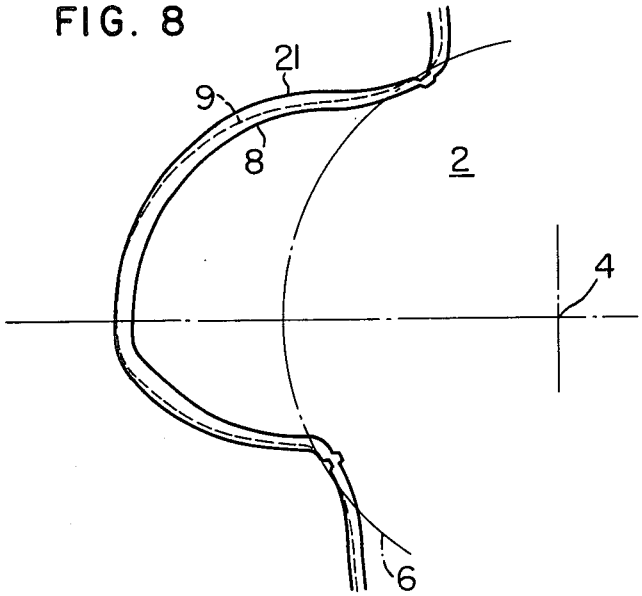
FIGS. 8 and 9 show a third embodiment, in explanation of a process for obtaining a screw rotor tooth form.
Figure 9:
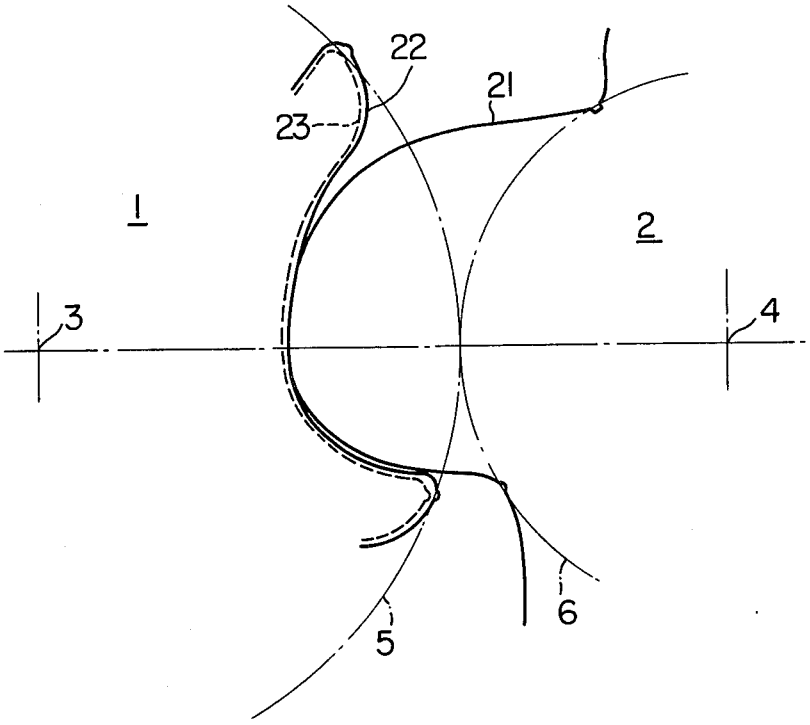

In the third embodiment of FIGS. 8 and 9, the male rotor is used as a reference and the basic tooth form 8 is given to the male rotor 2, as is the case with the first and second embodiments. The female rotor tooth form is obtained by taking into consideration the thermal expansion of the male and female rotors during operation and the backlash of the synchronizing gears.

A rotor tooth form 21 takes into consideration the backlash and thermal expansion, with the rotor tooth form 21 being composed of the rotor tooth form 9 produced by deformation of the basic tooth form 8 due to thermal expansion to which are added the backlash of the synchronizing gears and the necessary minimum clearance to avoid contacting of the rotors 1 and 2 in the process of meshing with each other. A rotor tooth form 22 of the female rotor 1 is generated by using the rotor tooth form 21 by taking into consideration the thermal expansion of the male rotor 2 and the backlash of the synchronizing gears. A rotor tooth form 23 of the female rotor 1 is obtained by converting the rotor tooth form 22 to a rotor tooth form in normal temperature condition. The tooth form 23 of the female rotor and the basic tooth form 8 of the male rotor are the final rotor tooth forms in the third embodiment which are employed in the assembled compressor of the present invention. The rotors when brought together in meshing engagement thus have a clearance at start-up which allows for their expansion. This clearance is maintained to a minimum during the operation of the compressor.

By deciding the shape of the female rotor 1 and the male rotor 2 in this way, no more clearance than is necessary to provide for the backlash of the synchronizing gears and prevent the rotors 1 and 2 from coming into contact with each other during operation is provided to the two rotors 1 and 2, so that gas leaks can be minimized and the efficiency of the screw compressor can be greatly increased.

The clearance between the rotors 1, 2 and the casing can be set at a minimum value because the amount of deformation of the rotors 1, 2 on account of thermal deformation can be clearly defined.

In the first, second and third embodiments of the invention, the axial temperature distribution both inside and outside the rotors during operation is kept constant. However, a substantial temperature gradient may exist axially of each rotor 1, 2 depending on the type of working fluid, pressure conditions and other operation conditions. When a temperature distribution on the suction side of low temperature and a temperature distribution on the discharge side of high temperature are taken into consideration, the rotor tooth form may be tapered in such a manner that its outer periphery decreases in going from the suction side toward the discharge side.

Figure 10:
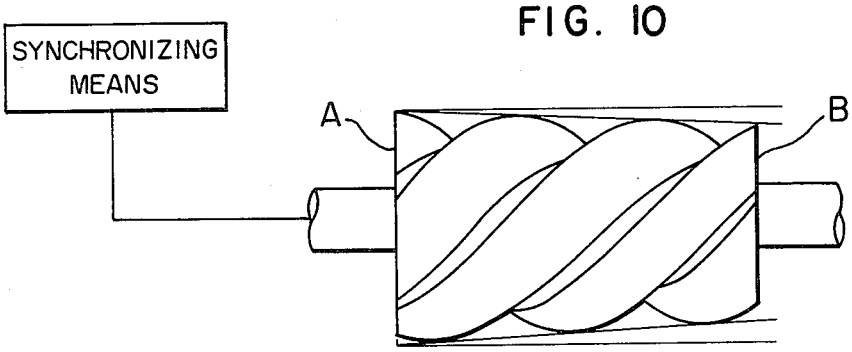
FIG. 10 is a side view of the screw rotor showing a modification thereof.

More specifically, as shown in FIG. 10, the rotor tooth form is tapering in such a manner that its outer periphery convergingly tapers in going from one end on the suction side A to the other end on the discharge side B.

Either one of the female and male rotors 1 and 2 or both of them may be tapering.

From the foregoing description, it will be appreciated that in the screw rotor according to the invention, the rotor tooth form of one of a female rotor and a male rotor meshing with each other without any clearance between them in normal temperature condition is used as a basic tooth form for obtaining a rotor tooth form produced by deformation on account of thermal expansion during operation, with the rotor tooth form thus obtained being used for generating another rotor tooth form. Moreover and the rotor tooth form thus generated is used to obtain a rotor tooth form which is a normal temperature version of the thermally deformed tooth form, to thereby use the rotor tooth form of the normal temperature version for the other of the female and male rotors. By virtue of this feature, it is possible to maintain a minimum clearance between the female and male rotors 1, 2 through the entire region of the rotor tooth forms in which the female and male rotors 1, 2 mesh with each other, to thereby greatly increase the efficiency and performance of the screw compressor and improve the reliability thereof.

The second and third embodiments of the invention have been described as being applied to screw rotors of a screw compressor of the dry type. Needless to say, they can have application in screw rotors of a screw compressor of the oil-cooled type.

What is claimed is:

1. A screw rotor of a screw compressor comprising a female rotor and a male rotor rotating about two axes parallel to each other while in meshing engagement with each other, the female and male rotors have a basic tooth form for enabling a meshing between the male and female rotors without any clearance therebetween during a normal temperature condition, one of the basic tooth forms of one of the male and female rotors is used for obtaining a first rotor tooth form produced by deformation due to a thermal expansion during an operation of the screw compressor; the first rotor tooth form is adapted to be used for generating a second rotor tooth form; and the second rotor tooth form is adapted to be used to obtain a further tooth form of the other of the female and male rotors which is a normal temperature tooth form of the second tooth form produced by deformation of the thermal expansion, whereby one of the basic tooth tooth forms and the further tooth form are the final version of the tooth forms of the respective rotors.

2. A screw rotor as claimed in claimed 1, wherein said female rotor and male rotor are shaped such that outer peripheral portions thereof taper from a lower pressure side toward a higher pressure side of the respective rotor.

3. A screw rotor as claimed in claim 1, wherein said female rotor is shaped such that an outer peripheral surface thereof tapers from a lower pressure side toward a higher pressure side of the rotor.

4. A screw rotor as claimed in claim 1, wherein said male rotor is shaped such that an outer peripheral portion thereof tapers from a lower pressure side toward a higher pressure side of the rotor.

5. A screw rotor of a screw compressor comprising a female rotor and a male rotor rotatable about two parallel axes through synchronizing means, the female and male rotors have a basic tooth form for enabling meshing between the male and female rotors without any clearance therebetween during normal temperature conditions, one of the basic tooth forms of one of the male and female rotors is used for obtaining a first rotor tooth form produced by deformation due to thermal expansion during operation of the screw compressor; the first rotor tooth form is adapted to be used for generating a second tooth form; the second tooth form is adapted to be used to obtain a third tooth form by reducing an amount corresponding to a backlash of the synchronizing means; and the third rotor tooth form is adapted to be used to obtain a further tooth form of the other of the male and female rotors which is a normal temperature tooth form of the second tooth form produced by the deformation of the thermal expansion, whereby one of the basic tooth forms and the further tooth form are the final versions of the tooth forms of the respective rotors.

6. A screw rotor as claimed in claim 5, wherein said female rotor and male rotor are shaped such that outer peripheral portions thereof taper from a lower pressure side toward a higher pressure side of the respective rotors.

7. A screw rotor as claimed in claim 5, wherein said female rotor is shaped such that an outer peripheral portion thereof tapers from a lower pressure side toward a higher pressure side of the rotor.

8. A screw rotor as claimed in claim 5, wherein said male rotor is shaped such that an outer peripheral portion thereof tapers from a lower pressure side toward a high pressure side of the rotor.

9. A screw rotor of a screw compressor comprising a female rotor and a male rotor rotatable about two parallel axes through a synchronizing means, the female and male rotors have a basic tooth form for enabling a meshing between the male and female rotors without any clearance therebetween in a normal temperature condition, the basic tooth form of one of the male and female rotors is used for obtaining a first rotor tooth form produced by deformation due to thermal expansion during operation of the screw compressor; a second tooth form is obtained by adding to the first rotor tooth form amounts corresponding to thermal expansion and backlash of the synchronizing means occurring during operation of the screw compressor; the second rotor tooth form being adapted to generate a third rotor tooth form; and the third rotor tooth form is adapted to be used to obtain a further rotor tooth form of the other of the male and female rotors which is a normal temperature tooth form of the second tooth form produced by the deformation of thermal expansion, whereby one of the basic tooth forms and the further tooth form are the final versions of the tooth forms of the rotor.

10. A screw rotor as claimed in claim 9, wherein said female rotor and male rotor are shaped such that outer peripheral portions thereof taper from a lower pressure side toward a higher pressure side of the respective rotor.

11. A screw rotor as claimed in claim 9, wherein said female rotor is shaped such that an outer peripheral portions thereof tapers from a lower pressure side toward a higher pressure side of the rotor.

12. A screw rotor as claimed in claim 9, wherein said male rotor is shaped such that an outer peripheral portion thereof tapers from a lower pressure side toward a higher pressure side of the rotor.

* * * * *